US010044129B2

(12) United States Patent
Qin

(10) Patent No.: US 10,044,129 B2
(45) Date of Patent: Aug. 7, 2018

(54) TELESCOPIC POWER PLUG WITH ROTATED HANDLE

(71) Applicant: AMBIT MICROSYSTEMS (SHANGHAI) LTD., Shanghai (CN)

(72) Inventor: Dong Qin, Shenzhen (CN)

(73) Assignee: AMBIT MICROSYSTEMS (SHANGHAI) LTD., Shanghai (CN)

( * ) Notice: Subject to any disclaimer, the term of this patent is extended or adjusted under 35 U.S.C. 154(b) by 0 days.

(21) Appl. No.: 15/641,272

(22) Filed: Jul. 4, 2017

(65) Prior Publication Data

US 2018/0026388 A1 Jan. 25, 2018

(30) Foreign Application Priority Data

Jul. 19, 2016 (CN) ..... 2016 1 0571040

(51) Int. Cl.

| | |
|---|---|
| ***H01R 13/44*** | (2006.01) |
| ***H01R 13/447*** | (2006.01) |
| ***H01R 13/502*** | (2006.01) |
| ***H01R 24/28*** | (2011.01) |
| *H01R 103/00* | (2006.01) |

(52) U.S. Cl.

CPC ..... *H01R 13/447* (2013.01); *H01R 13/502* (2013.01); *H01R 24/28* (2013.01); *H01R 2103/00* (2013.01)

(58) Field of Classification Search

CPC ..... H01R 13/44; H01R 13/4538
USPC ..... 439/131
See application file for complete search history.

(56) References Cited

U.S. PATENT DOCUMENTS

| | | | | |
|---|---|---|---|---|
| 6,382,996 | B1 | 5/2002 | Eyman | |
| 7,381,067 | B2 * | 6/2008 | Sze | H01R 27/00 439/131 |
| 8,197,267 | B2 * | 6/2012 | Kuo | H01R 24/30 439/131 |

FOREIGN PATENT DOCUMENTS

| | | | |
|---|---|---|---|
| CN | 2702483 | Y | 5/2005 |
| CN | 203277724 | U | 11/2013 |
| CN | 204243289 | U | 4/2015 |
| TW | 201203750 | A1 | 1/2012 |
| TW | 201415735 | A | 4/2014 |

* cited by examiner

*Primary Examiner* — Phuong Dinh
(74) *Attorney, Agent, or Firm* — ScienBiziP, P.C.

(57) ABSTRACT

A telescopic power plug includes a handle, a plug body and an inner sleeve. The handle is threadedly engaged with the plug body. The plug body with an irregular shape end is engaged with an irregular shape end of the inner sleeve. The irregular shape engagement makes the plug body movement produced only in the axial direction. The plug body is extended or retracted in the inner sleeve by rotating the handle. The handle operation force is uniform and stable.

19 Claims, 14 Drawing Sheets

100

100

100

TELESCOPIC POWER PLUG WITH ROTATED HANDLE

FIELD

The subject matter herein generally relates to a power plug, and more particularly to a telescopic power plug.

BACKGROUND

Conventional chargers are typically made of two types. One type of chargers has a plug with fixed pins. The pins are mounted on a plug body and protrude from the plug body. Objects close to the pins have a chance to be scratched by the pins because the pins are exposed from the plug body. Another type of chargers has a plug with movable pins. A plug body has a groove. When the charger is not in use, the pins rotate 90 degrees to be received in the groove or sliding along the groove to be hidden in the plug body. For the pins rotated or sliding in the groove, both of them have no block position to stay still without moving when being used, and the pins inserted into the socket are unstable.

BRIEF DESCRIPTION OF THE DRAWINGS

Implementations of the present technology will now be described with reference to the attached figures.

DETAILED DESCRIPTION

Figure 1:
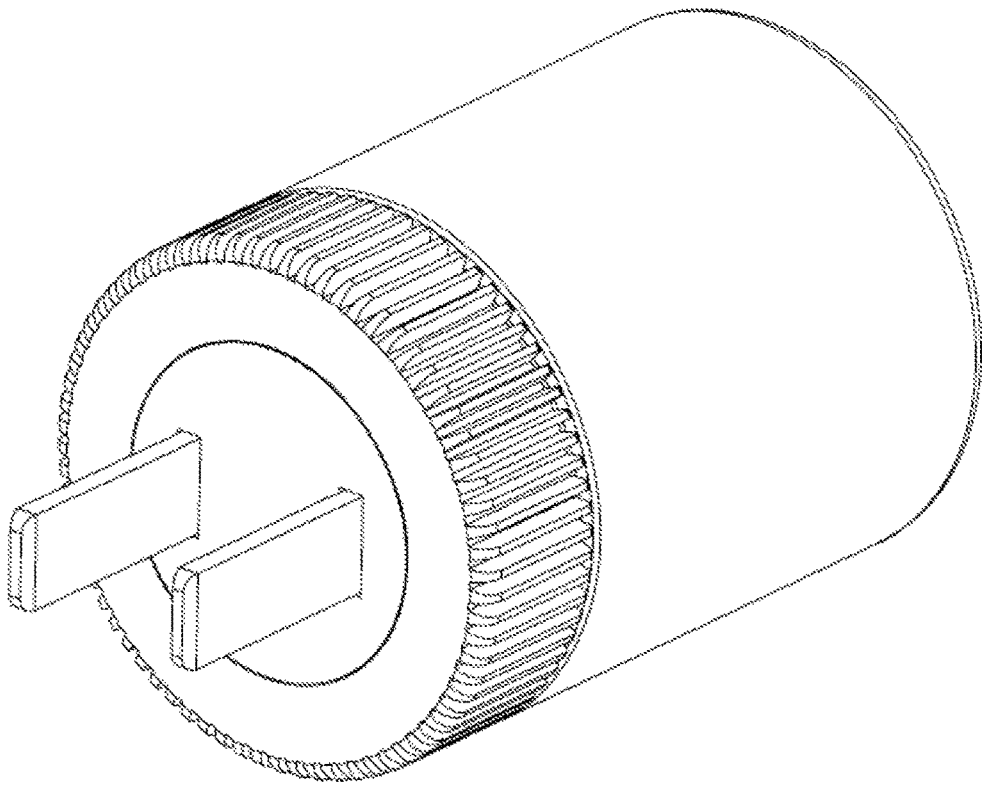
FIG. 1 is an isometric view of an exemplary embodiment of an assembled structure with pins extended out from a telescopic power plug.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like reference numerals indicate the same or similar elements. It should be noted that references to "an" or "one" exemplary embodiment in this disclosure are not necessarily to the same exemplary embodiment, and such references can mean "at least one".

Figure 2:
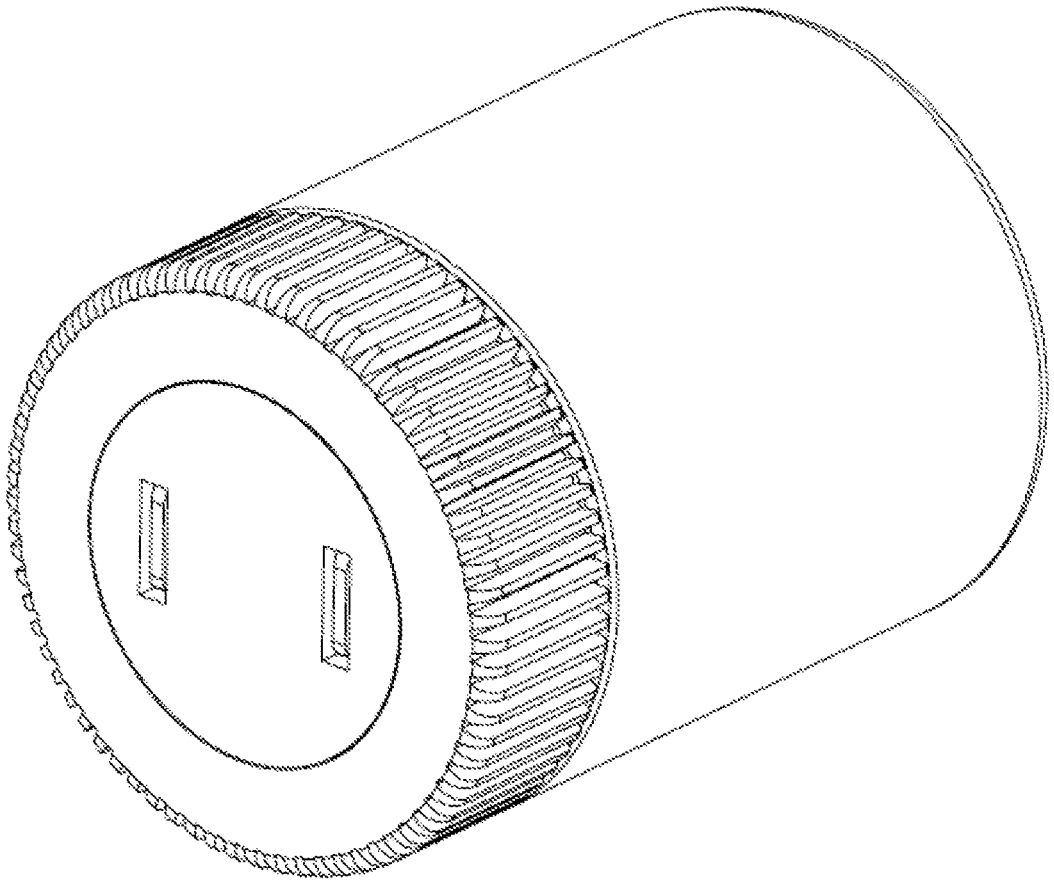
FIG. 2 is an isometric view of an assembled structure with pins retracted in of the telescopic power plug.
Figure 3:
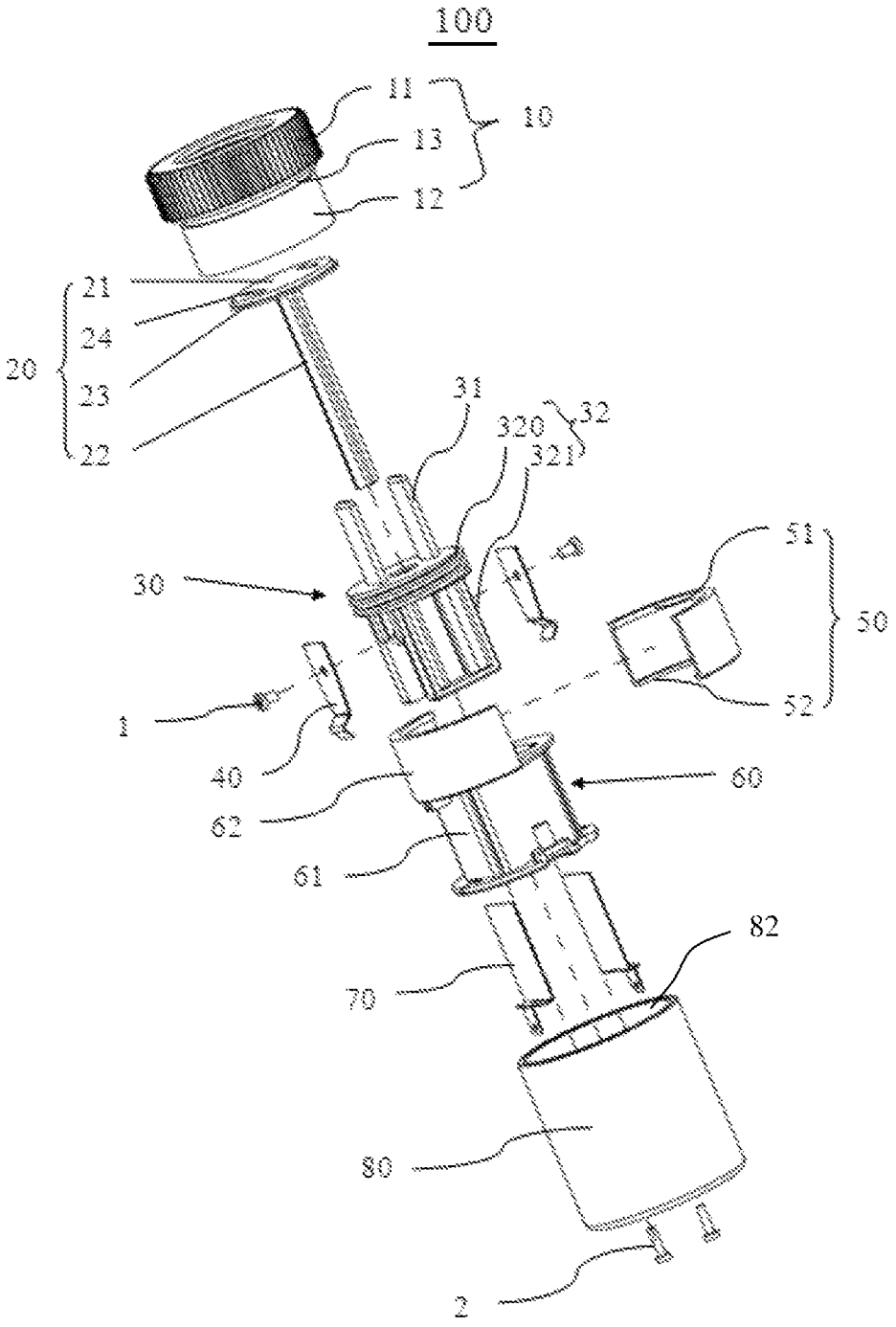
FIG. 3 is an exploded isometric view of the telescopic power plug in FIG. 1.

Referring to FIG. 1 to FIG. 3, an exemplary embodiment of a telescopic power plug 100 includes a handle 10, a panel 20, a plug body 30, a first shrapnel 40, a first cover 50, an inner sleeve 60, a second shrapnel 70, a housing 80, a first fastener 1 and a second fastener 2. The panel 20, the plug body 30, the first shrapnel 40, the first cover 50, the inner sleeve 60 and the second shrapnel 70 are received in a space surrounded by the handle 10 and the housing 80. The first shrapnel 40 and the second shrapnel 70 are connection with a wire (not shown).

Figure 4:
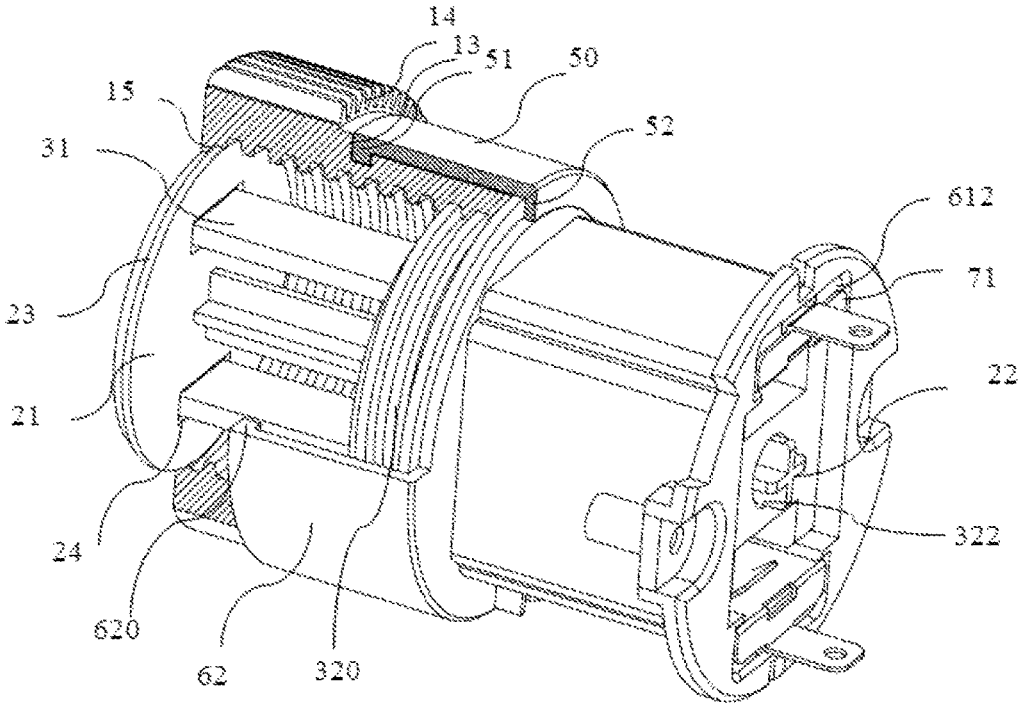
FIG. 4 is an isometric view of the telescopic power plug without a housing and part of a second cover in FIG. 1.

Referring to FIG. 3 and FIG. 4, the handle 10 includes a rotating portion 11 and a sleeve 12. An annular groove 13 connects between the rotating portion 11 and the sleeve 12. The diameter of the rotating portion 11 is greater than the diameter of the sleeve 12, and an annular end 14 formed in a bottom end of the rotating portion 11 resists against the housing 80. An annular step 15 is formed in an inner wall of a top end of the rotating portion 11. The handle 10 has an inner wall provided with an inner screw thread, the inner screw thread extends from the annular step 15 of the rotating portion 11 to a bottom end of the sleeve 12. A first receiving space 16 (FIG. 13) is formed by a space surrounded by the inner screw thread of the handle 10. The rotating portion 11's peripheral has an antiskid tread and convenient for users increasing friction during rotation.

Referring to FIG. 3, the panel 20 includes an annular table 21 and a guide pole 22 extended from a bottom surface of the annular table 21. The annular table 21 has an annular lug 23 and a first aperture 24. The annular lug 23 resists against the annular step 15 (FIG. 4) of the rotating portion 11, and a top surface of the annular table 21 is substantially coplanar with a top end of the rotating portion 11. The guide pole 22 resists against an inner end of the housing 80, the panel 20 is located between the rotating portion 11 and the housing 80, the panel 20 resists against the handle 10 and the housing, and the panel 20 does not move when the plug body 30 moves.

Figure 5:
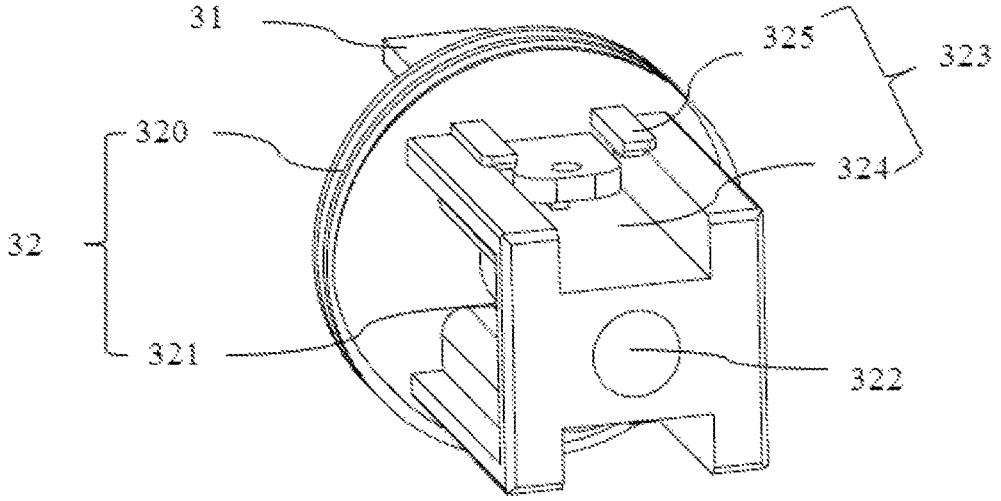
FIG. 5 is an isometric view of a plug body in FIG. 1.
Figure 6:
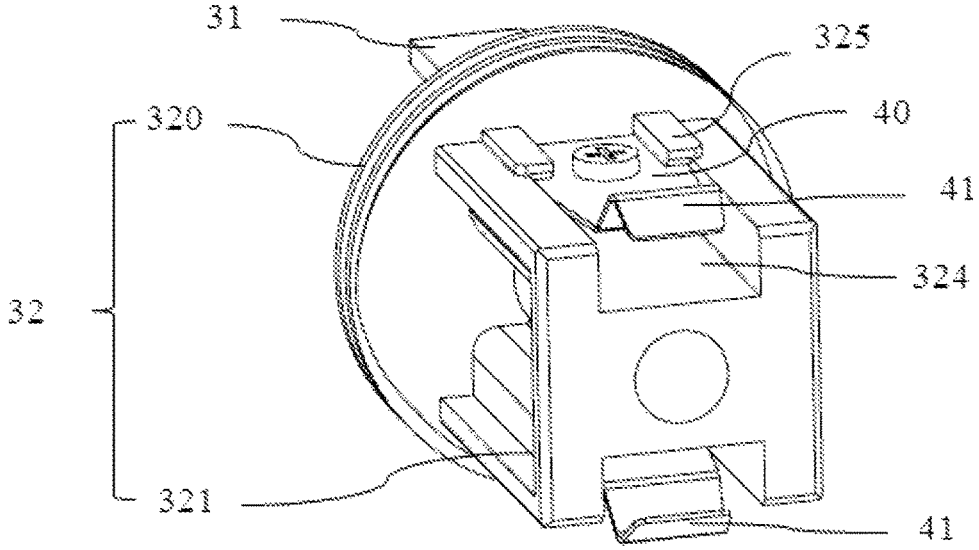
FIG. 6 is an isometric view showing the plug body assembled with a first shrapnel in FIG. 1.

Referring to FIGS. 3, 5 and 6, the plug body 30 includes two pins 31 and a base 32. The base 32 includes a connection portion 320 and a guide seat 321. The centre of the base 32 has a guide hole 322 passing through the connection portion 320 and the guide seat 321. The connection portion 320 is integrally formed with the guide seat 321. The guide seat 321 has a square or irregular shape. The connection portion 320 has an outer screw thread for threadedly engaged with the handle 10. The guide seat 321 is extended from a bottom surface of the connection portion 320, and two insert slots 323 are on opposite ends of the guide seat 321. The two insert slots 323 are formed by a concave portion 324 and a block 325 extended from two ends of the concave portion 324. When the first shrapnel 40 is inserted into the two insert slots 323, the block 325 guides the first shrapnel 40 into the two insert slots. The two pins 31 are mounted on the connection portion 320. The two pins 31 extend through a second aperture (not shown) of the connection portion 320 and into the two insert slots 323. In this exemplary embodiment, the pin 31 has a hole inside the insert slot 323, the guide seat 321 has a thread hole corresponding to the hole of the pins 31 for connecting with each other.

The first shrapnel 40 has a straight portion 42 and an arc portion 41 coupled to one end of the straight portion 42. The first shrapnels 40 are inserted into the two corresponding insert slots 323 of the guide seat 321 and contact with the two pins 31. In this exemplary embodiment, each of the first shrapnels 40 has a hole corresponding to a thread hole of the guide seat 321, where the first fasteners 1 connect the first shrapnels 40 to their corresponding guide seats 321. In other exemplary embodiments, the two pins 31 and the first shrapnels 40 adopt welding connection instead of screw thread connection, and are stopped by the two insert slots 323.

Referring to FIG. 3, the first cover 50 has a circular arc shape. The first cover 50 has a first clip bar 51 and a second clip bar 52. The first clip bar 51 and the second clip bar 52 are extended from an inner side of the first cover 50, and extended in a radial direction.

Figure 7:
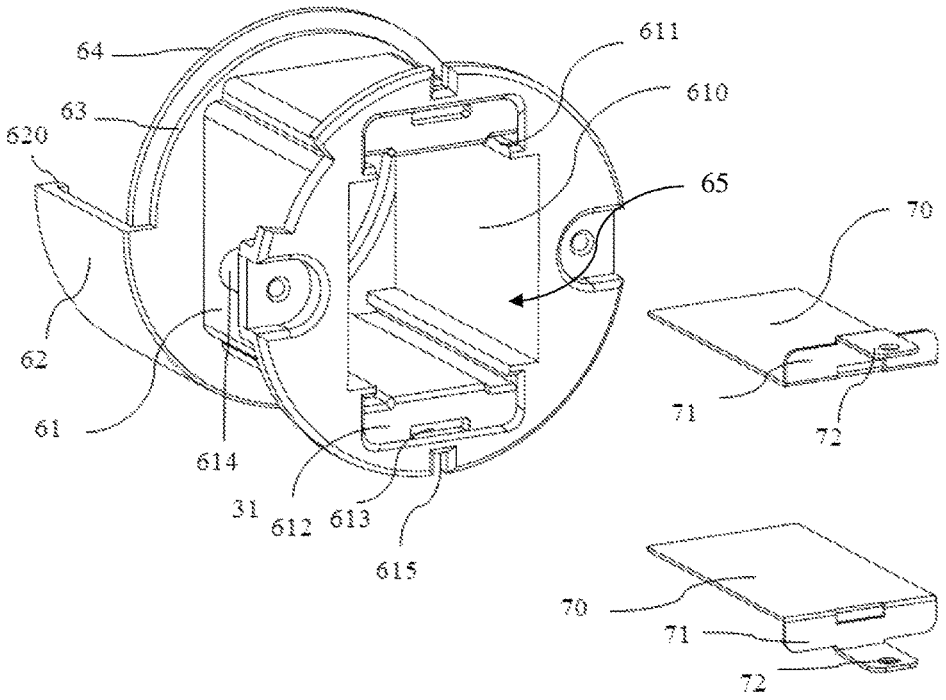
FIG. 7 is an isometric view showing an inner sleeve disassembled with a second shrapnel in FIG. 1.
Figure 8:
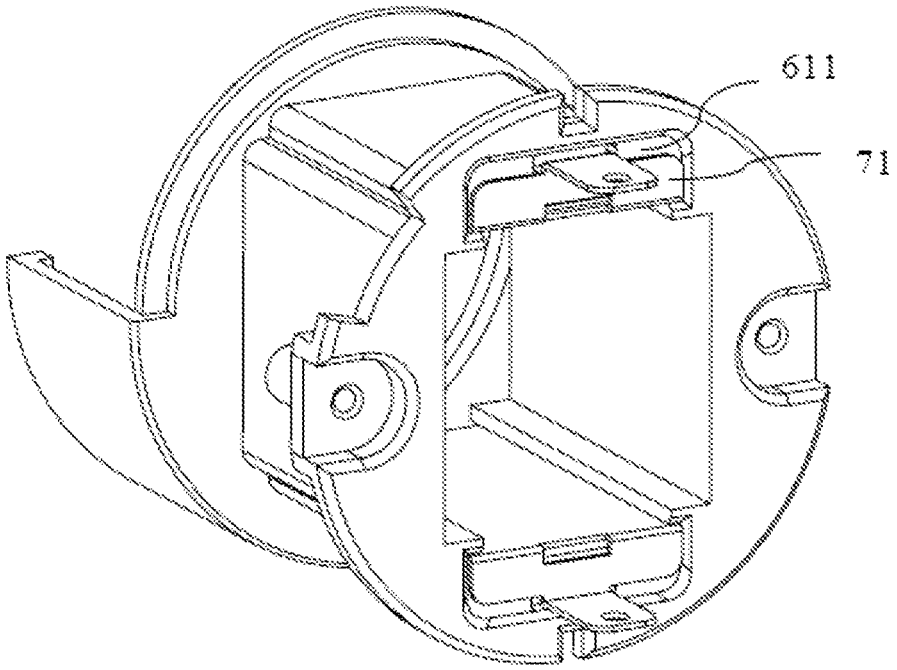
FIG. 8 is an isometric view showing the inner sleeve assembled with the second shrapnel in FIG. 1
Figure 9:
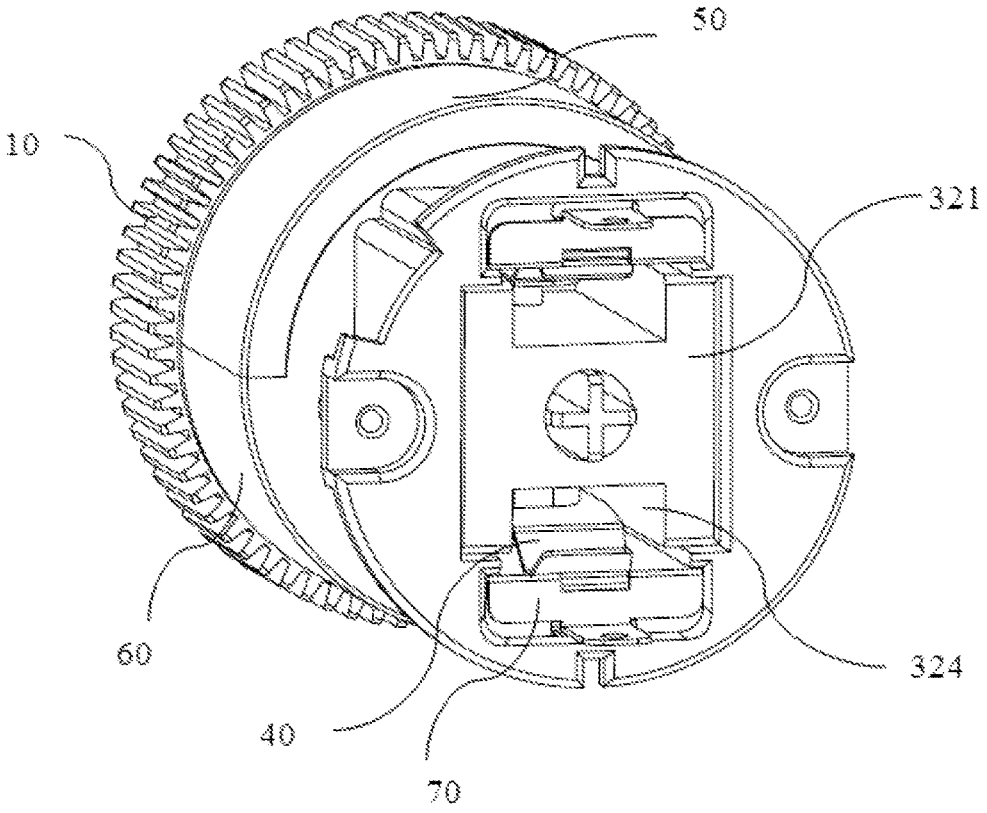
FIG. 9 is an isometric view of the telescopic power plug without the housing in FIG. 1.

Referring to FIGS. 3 and 7, the inner sleeve 60 includes a sleeve seat 61 and a second cover 62. The second cover 62 is extended from a portion of a top end of the sleeve seat 61, and the first table 63 and the second table 64 are extended from another portion of the top end of the sleeve seat 61. The first table 63 and the second table 64 each have an arc side surface. The second table 64 extends from a top end of the first table 63. The first table 63 has a central angel of a circle, the second table 64 has a central angle of another circle, the central angel of the first table 63 is equal to the central angle of the second table 64, and a radius of the first table 63 is smaller than a radius of the second table 64. The second clip bar 52 of the first cover 50 resists the arc side surface of the first table 63 and hooked by a bottom end of the second table 64. The sum of the central angle of the first table 63 and the central angle of the second cover 62 is 360 degrees, which forms a circle. The second cover 62 is substantially coplanar with the first table 63.

As shown in FIGS. 3 and 7, one end of the second cover 62 has a third clip bar 620, the sleeve seat 61 includes an embedding slot 610 and a guide groove 611. A bottom end of the sleeve seat 61 has a step surface 612 with a recess 613. Two convex columns 614 each have a central screw hole extending out from the bottom end of the sleeve seat 61. The second receiving space 65 is formed by a space surrounded by the embedding slot 610. The embedding slot 610 is in communication with the guide groove 611. The second receiving space 65 has a matching shape for the guide seat 321 to be inserted in. The guide groove 611 is for receiving the second shrapnel 70, and for guiding the second shrapnel 70 in the process of being inserted. One end of the sleeve seat 61 has a clip slot 615, another end of the sleeve seat 61 has another clip slot 615, and the clip slot 615 of the sleeve seat 61 is corresponding to the another clip slot 615 of the sleeve seat 61. In this exemplary embodiment, the bottom end of the sleeve seat 61 is provided with a screw hole instead of the convex column 614. Referring to FIG. 3, the housing 80 is threadedly engaged with the sleeve seat 61 by a second fastener 2.

Figure 12:
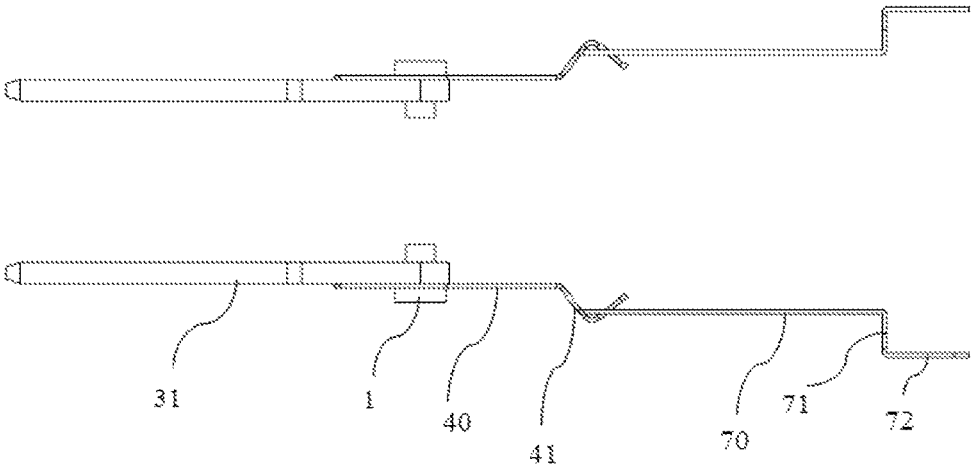
FIG. 12 is an isometric view showing the first shrapnel connected with the second shrapnel with the pins extended out from the telescopic power plug in FIG. 1.

Referring to FIGS. 3, 7 and 12, the second shrapnel 70 has a bent portion 71 and an electrical connection portion 72 perpendicular to the bent portion 71. The bent portion 71 of the second shrapnel 70 is engaged with the step surface 612 of the sleeve seat. The second shrapnel 70 is inserted into the guide groove 611 of the sleeve seat 61. The bent portion 71 and electrical connection portion 72 form an arch shape to tightly engage with the recess 613 of the sleeve seat 61. When an external force is exerted on the second shrapnel 70, the step surface 612 restricts the second shrapnel 70's movements, and prevents deformation of the second shrapnel 70. The second shrapnel 70 contacts with the first shrapnel 40 at all time. The electrical connection portion 72 is used to electrically connected with a wire.

Figure 10:
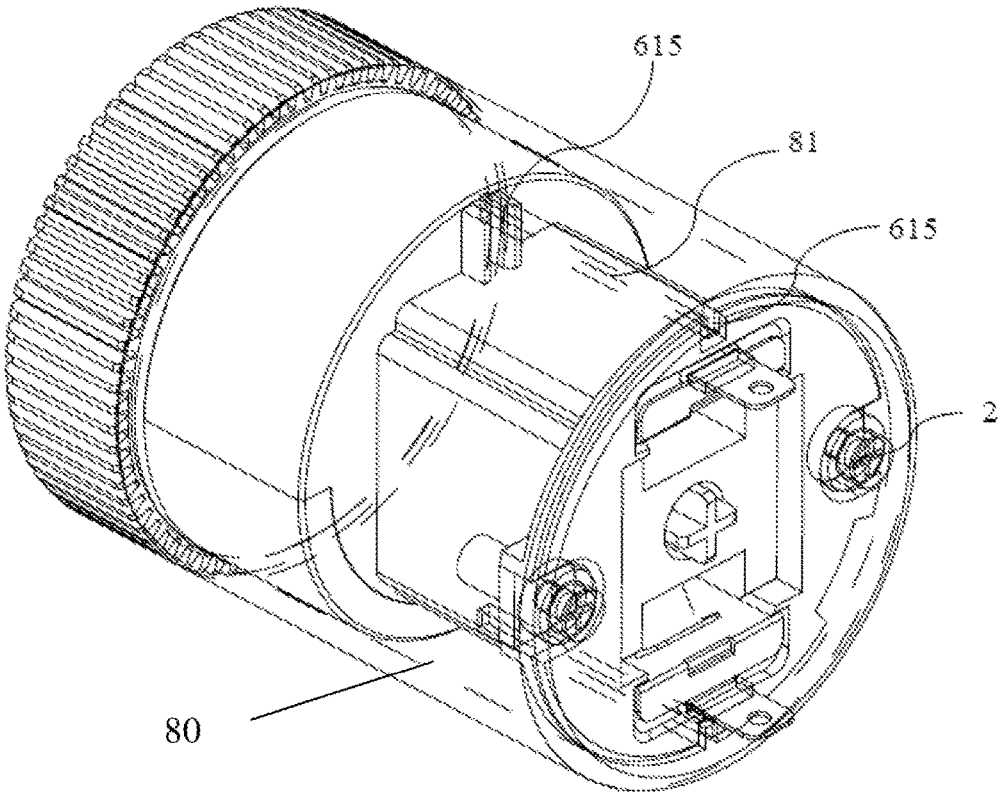
FIG. 10 is an isometric view of the telescopic power plug with the transparent cover.

Referring to FIG. 10, the housing 80 has a circular shape. < > In other exemplary embodiments, the housing 80 can have other shapes, such as a square shape. The rotating portion 11 of the handle 10 protrudes from an opening 82 (shown in FIG. 3) of the housing 80 for rotation. An inner side of the housing 80 has a plurality of ribs 81, one of the plurality of ribs 81 engages with the clip slot 615 on the two ends of the sleeve seat 61, and the plurality of ribs 81 and the clip slot 615 are used to prevent rotation of the housing 80 relative to the inner sleeve 60. The housing 80 has a hole for the second shrapnel 70 to pass through and electrically connect to a wire.

Referring to FIG. 11 to FIG. 14, when the telescopic power plug 100 is assembled, the guide pole 22 of the panel 20 is inserted into the guide hole 322 (shown in FIG. 5) of the plug body 30. The two pins 31 pass through the first apertures 24 of the panel 20. The first shrapnels 40 are inserted into the corresponding insert slots 323 (shown in FIG. 5) of the plug body 30 (the first shrapnels 40 also can be inserted into the corresponding insert slots 323 after the plug body 30 is engaged with the handle 10). The plug body 30 with the panel 20 is screwed into the inner screw thread of the handle 10 through the outer screw thread of the connection portion 320. The guide pole 22 moves toward a top end of the rotating portion 11. The annular lug 23 of the annular table 21 resists the annular step 15 of the rotating portion 11 (FIG. 4).

The third clip bar 620 of the sleeve seat 61 is buckled into the annular groove 13 of the handle 10. The first clip bar 51 is buckled into the annular groove 13 of the handle 10. The second clip bar 52 is buckled into a side end of the second stable 64 of the inner sleeve 60. The first cover 50 is engaged with the second cover 62 to form a ring shape to surround the sleeve 12, and a bottom end of the sleeve 12 resists against a top end of the sleeve seat 61. Parts of the base 32 of the plug body 30 and parts of the first shrapnel 40 is embedded into the embedding slot 610. The second shrapnel 70 is inserted into the guide groove 611 and electrically connected to the first shrapnel 40. The bent portion 71 of the second shrapnel 70 is engaged with the step surface 612. The electrical connection portion 72 and the bent portion 71 connected is forced to resist against the recess 613 of the sleeve seat 61.

The housing 80 is coiled around the inner sleeve 60, and an opening end of the housing 80 resists against the annular end 14 of the rotating portion 11. The end of the guide pole 22 resists against an inner end of the housing 80. The plurality of ribs 81 are buckled into the clip slot 615 of the inner sleeve 60 to limit the housing 80 rotation relative to the inner sleeve 60. The second shrapnel 70 passes through the hole of the with the bent portion 71 resists against the inner side of housing 80. The housing 80 is mounted on the inner sleeve 60 by the second fastener 2. The electrical connection portion is electrically connected to a wire, the telescopic power plug 100 is finished assembled. Therefore, the rotating portion 11 is exposed out for rotation operation. One end of the panel 20 resists against the annular step 15 of the rotating portion 11, and the other end of the panel resists against the inner surface of the housing 80. The panel 20 and the second shrapnel 70 is limited. The panel 20 does not move when the plug body 30 moves. The base 32 of the plug body 30 has a length greater than a length of the sleeve 12 of the handle 10, and the guide seat 321 is not completely separated from the embedding slot 610 and the second receiving space 65.

Figure 11:
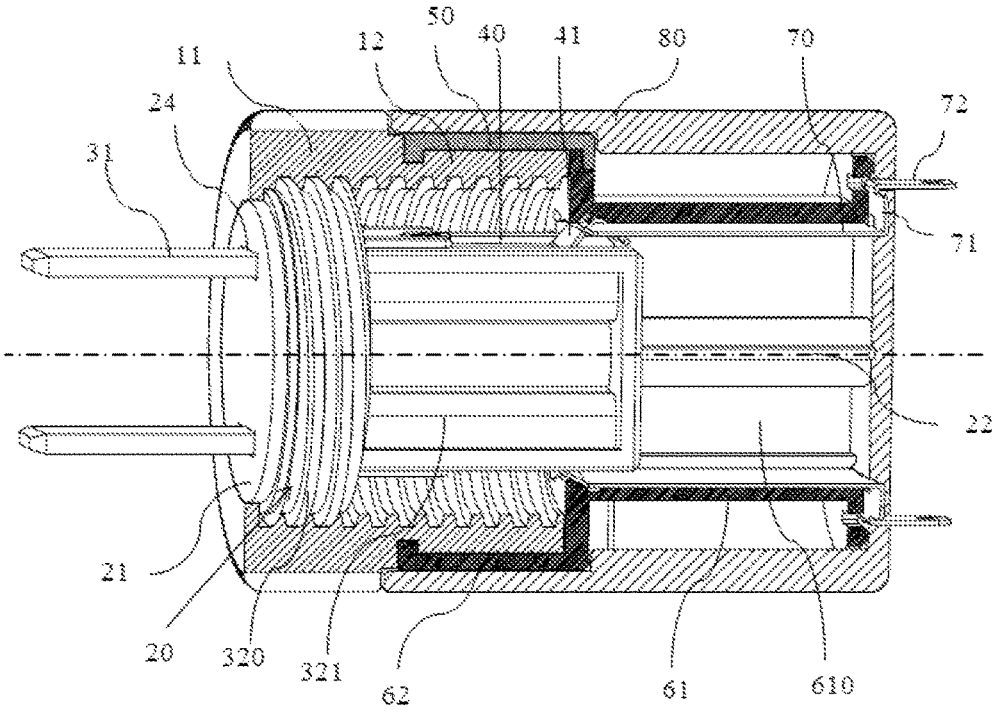
FIG. 11 is partially cross-sectional view of the telescopic power plug with the pins extended out from the telescopic power plug in FIG. 1.
Figure 13:
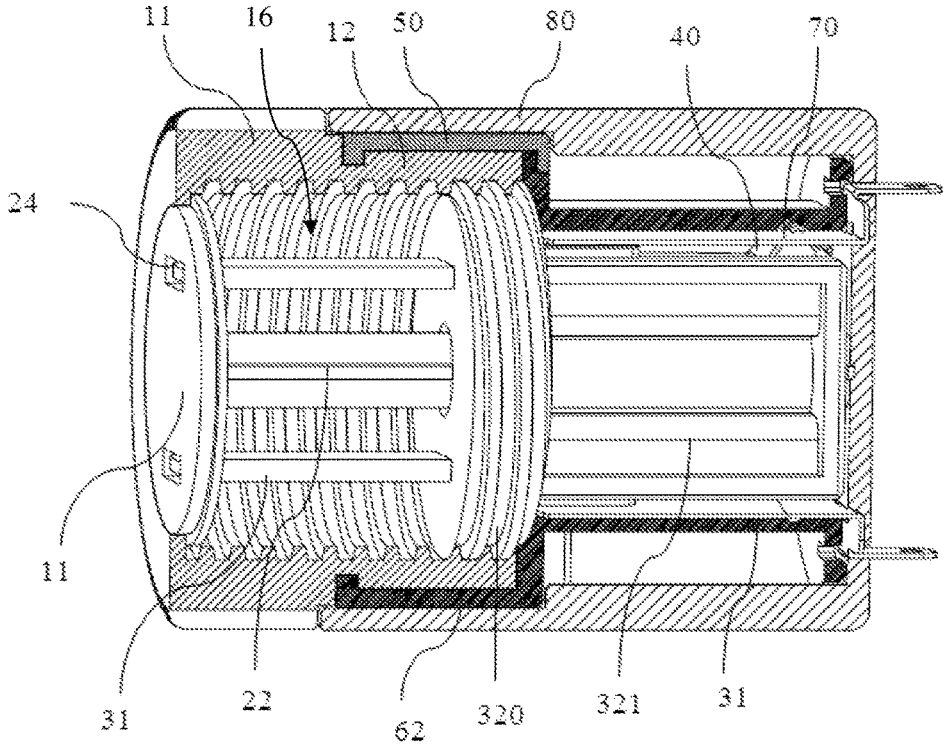
FIG. 13 is partially cross-sectional view of the telescopic power plug with the pins retracted in the telescopic power plug in FIG. 1.
Figure 14:
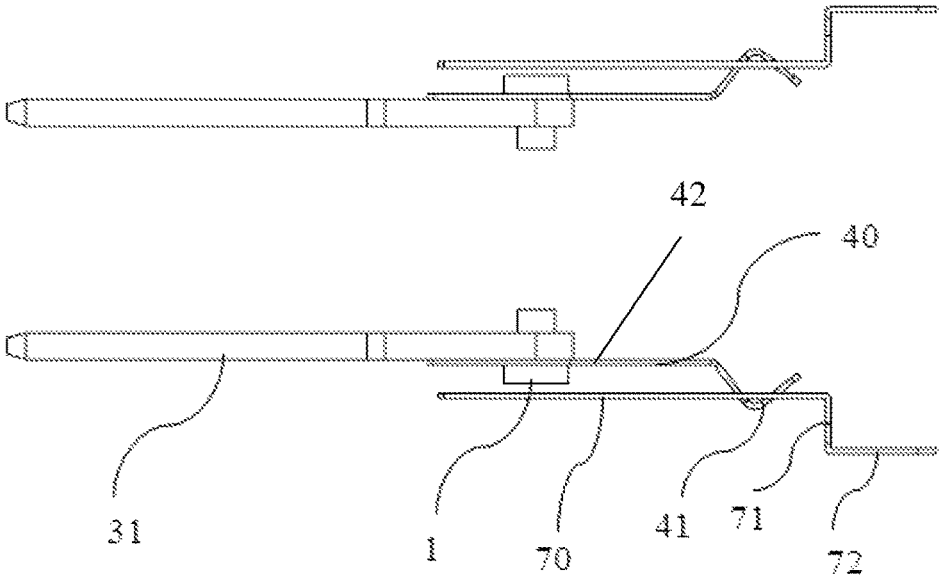
FIG. 14 is an isometric view showing the first shrapnel connected with the second shrapnel with the pins retracted in the telescopic power plug in FIG. 1.

Referring to FIG. 11 and FIG. 13, when the telescopic power plug 100 is used, the rotating portion 11 of the handle 10 is rotated, the inner screw thread of the handle 10 is threadedly engaged with the outer screw thread of the connection portion 320. The plug body 30 moves toward the handle 10, the guide pole 22 of the panel 20 guides the plug body 30 moving in a central position and stability. The guide seat 321 has square or irregular shape, the guide seat 321 engaged with the second receiving space 65 of the inner sleeve 60 limits the plug body 30 to rotate. The inner screw thread of the handle 10 is threadedly with the outer screw thread of the connection portion 320 to make the plug body 30 moving in an axial direction. In another exemplary embodiment, the guide seat 321 can be another non-circular structure, and the inner sleeve 60 has a groove to match with the guide seat to limit the plug body 30 to rotate. The two pins 310 is extended out from the first aperture 24 of the panel 20. When the plug body 30 moves in the whole process, the second shrapnel 70 contacts with arc portion 41 of the first shrapnel 40 all the time to make sure electrical connection.

When a top surface of the connection portion 320 touches with a bottom surface of the panel 20, the two pins 31 is completely extended out to connect with a socket, and the two pins 31 and the socket is stable connection for threadedly engagement of the handle 10 and the plug body 30.

When the telescopic power plug 100 is not used, the telescopic power plug 100 is pulled from the socket and made an opposite direction to rotate the rotating portion 11 of the handle 10. The plug body 30 moves away from the handle 10 until the plug body 30 and the two pins 31 are entirely received in the second receiving space 65 formed by the embedding slot 610 and the guide groove 611. The first receiving space 16 is in communication with the second receiving space 65.

In the embodiment, the two pins 31 are two, of course, the two pins can be three or more, at the same time, the base 32 of the plug body 30 with different shapes to match with the second receiving space 65 of the inner sleeve 60, the panel 20 has corresponding holes for the two pins to pass through, the base 32 has corresponding insert slot and increases corresponding shrapnel for the corresponding two pins to work.

The exemplary embodiments shown and described above are only examples. Many details are often found in the art such as the other features of case with device for tool free unlocking access. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A telescopic power plug comprising:

a handle having a first receiving space, a rotating portion, a sleeve and an annular groove connects between the rotating portion and the sleeve;

a plug body having two pins and a base with a guide seat; and an inner sleeve having a second receiving space matched with the guide seat, wherein:

the inner sleeve is engaged with the annular groove, the first receiving space is in communication with the second receiving space, the plug body is received in the first receiving space and the second receiving space;

when the handle is rotated, the handle drives the plug body to move in the first receiving space and the second receiving space, and the two pins are extended out or retracted from the handle.

2. The telescopic power plug of claim 1, wherein the handle has an inner wall provided with an inner screw thread, and the first receiving space is formed by a space surrounded by the inner screw thread.

3. The telescopic power plug of claim 2, wherein the base has a length greater than a length of the sleeve, and the guide seat is not completely separated from the second receiving space.

4. The telescopic power plug of claim 2, wherein the base further comprises a connection portion provided with an outer screw thread, and the handle is threadedly engaged with the connection portion to make the plug body moving in an axial direction.

5. The telescopic power plug of claim 2, further comprising a first cover with two ends extending a first clip bar and a second clip bar, wherein the first clip bar and the second clip bar are extended from an inner side of the first cover and extended in a radial direction.

6. The telescopic power plug of claim 5, wherein the inner sleeve comprises a sleeve seat and a second cover, a top end of the sleeve seat has a first table and a second table, a bottom end of the sleeve seat has a step surface with a recess, one end of the second cover has a third clip bar, the guide seat is inserted into the second receiving space, and the guided seat is engaged with the second receiving space to limit the plug body to rotate.

7. The telescopic power plug of claim 6, wherein the sleeve seat comprises an embedding slot and a guide groove, and the second receiving space is formed by a space surrounded by the embedding slot.

8. The telescopic power plug of claim 6, wherein the second cover is arc-shaped, the second cover is extended from a portion of the top end of the sleeve seat, the first table and the second table is extended from another portion of the top end of the sleeve seat, the first table and the second table each has an arc side surface, and the second cover is substantially coplanar with the first table.

9. The telescopic power plug of claim 6, wherein the first table has a central angel of a circle, the second table has a central angle of another circle, the central angel of the first table is equal to the central angle of the second table, a radius of the first table is smaller than a radius of the second table, the second clip bar of the first cover resist the arc side surface of the first table and hooked by a bottom end of the second table, and the first cover is engaged with the second cover to for a ring shape to surround the sleeve.

10. The telescopic power plug of claim 6, further comprising a housing, wherein the first clip bar is engaged with the annular groove, the second clip bar is buckled into the second stable of the inner sleeve, the third clip bar is engaged with the annular groove, the guide seat is inserted into the second receiving space, and the sleeve, the plug body and the inner sleeve are installed in the housing.

11. The telescopic power plug of claim 10, wherein two ends of the sleeve seat have clip slot, an inner side of the housing has a plurality of ribs, one end of the plurality of ribs engages with the clip slot on the two ends of the sleeve seat, and the plurality of ribs and the clip slot are used to limit the housing rotation relative to the inner sleeve.

12. The telescopic power plug of claim 10, further comprising a panel, wherein the panel includes an annular table and a guide pole, and the annular table has an annular lug and a first aperture.

13. The telescopic power plug of claim 12, wherein the plug body has a guide hole, the two pins are mounted on the connection portion, the two pins are extended from the connection portion, the guide pole of the panel is inserted in the guide hole, and the two pins pass through from the first aperture.

14. The telescopic power plug of claim 12, wherein the guide pole resists against an inner end of the housing, the panel resists against the handle and the housing, and the panel remains stationary when the plug body moves.

15. The telescopic power plug of claim 12, wherein the diameter of the rotating portion is greater than the diameter of the sleeve, an annular end formed in a bottom end of the rotating portion resists the housing, an annular step is formed in an inner wall of the bottom end of the rotating portion, the annular lug resists against the annular step, and a top end of the annular table is substantially coplanar with the rotating portion.

16. The telescopic power plug of claim 15, wherein the housing has an opening, the opening resists the annular end of the rotating portion, and the housing is connected with the sleeve seat by a second fastener.

17. The telescopic power plug of claim 9, further comprising a first shrapnel and a second shrapnel, wherein the first shrapnel has an arc portion, the second shrapnel has a bent portion and an electrical connection portion, the arc portion of the first shrapnel is contact with one end of the second shrapnel, and the bent portion and electrical connection portion form an arch shape to engaged with the recess of the step surface.

18. The telescopic power plug of claim 17, wherein two insert slots are on opposite ends of the guide seat, and the first shrapnel and the second shrapnel is inserted into the two insert slots.

19. The telescopic power plug of claim 17, wherein the electrical connection portion of the second shrapnel passes through a hole of the housing for electrically connected to a wire.

* * * * *